United States Patent [19]

Beigl et al.

[11] Patent Number: 4,728,032

[45] Date of Patent: Mar. 1, 1988

[54] LOADING MEMBERS FOR RAILROAD TRACK

[75] Inventors: Gert Beigl, Salzburg; Peter Burtscher, Bludenz; Martin Dietrich, Übersaxen, all of Austria; Karl A. Kohler, Gruenwald, Fed. Rep. of Germany; Karl Konzett, Buers; Karl H. Ruedisser, Nueziders, both of Austria

[73] Assignee: Getzner-Chemie Gesellschaft m.b.H.

[21] Appl. No.: 912,591

[22] Filed: Sep. 26, 1986

[30] Foreign Application Priority Data

Oct. 2, 1985 [AT] Austria ..... 2851/85

[51] Int. Cl.[4] ..... E01B 26/00

[52] U.S. Cl. ..... 238/382; 238/2

[58] Field of Search ..... 238/381, 1, 2, 8, 6, 238/7, 9

[56] References Cited

U.S. PATENT DOCUMENTS

| | | | |
|---|---|---|---|
| 1,275,321 | 8/1918 | Suter | 238/8 |
| 2,279,262 | 4/1942 | Edwards | 106/97 X |
| 4,050,949 | 9/1977 | Lundgren et al. | 106/97 |
| 4,356,968 | 11/1982 | Harmsen | 238/1 |
| 4,365,743 | 12/1982 | Trickel et al. | 238/8 |

FOREIGN PATENT DOCUMENTS

| | | | |
|---|---|---|---|
| 1012628 | 7/1957 | Fed. Rep. of Germany | 238/8 |
| 2729248 | 1/1979 | Fed. Rep. of Germany | 238/382 |
| 3315697 | 11/1984 | Fed. Rep. of Germany . | |
| 0139434 | 1/1980 | German Democratic Rep. | 238/382 |

*Primary Examiner*—Robert B. Reeves
*Assistant Examiner*—Scott H. Werny
*Attorney, Agent, or Firm*—Loren, McGeady & Associates

[57] ABSTRACT

A railroad track including rails and transversely extending ties. The end portions of the ties are placed on a rigid substructure. For reducing the sound emission, loading members are placed on the ties between the rails. These loading members have an essentially T-shaped cross-section, wherein the horizontally projecting portions are placed on adjacent ties. Sound-insulating elastic inserts may be provided between the ties and the loading members. Consequently, no fittings for fastening the loading members are required. In addition, the space existing between the ties is utilized in an optimum manner by filling it with sound-insulating material.

9 Claims, 3 Drawing Figures

LOADING MEMBERS FOR RAILROAD TRACK

BACKGROUND OF THE INVENTION

1. Field of the Invention

The invention relates to a railroad track including rails and ties extending transversely of and connected to the rails. The end portions of the ties rest on a rigid substructure preferably of concrete or steel. A sound insulating layer may be provided between the ties and the substructure. For reducing the sound emission, solid loading members preferably of concrete or reinforced concrete are placed on the portions of the ties extending between the rails.

2. Description of the Prior Art

German Offenlegungsschrift No. 33 15 697 discloses a railroad track of the above-described type in which the sound emission is improved especially in the frequency range of from 10 to 25 Hz by connecting loading members having great weights to the ties of this railroad track. The loading members are of concrete or of hollow steel sections filled with concrete. Each loading member has the shape of a right parallelepiped and its size corresponds to the cross-sectional sides of the tie. The loading members are either placed directly onto the ties or they are fastened to the bottom of the ties. Whether the loading members are placed on the top of the ties or are connected to the bottom sides thereof, in either case it is necessary to use fittings for fastening these loading members.

It is, therefore, the primary object of the invention to improve the railroad track of the type described above, so that no fittings are required for mounting the loading members.

Another object of the invention is to provide loading members which utilize the space available in the railraod track in an optimum manner, because great weights are required for an appropriate reduction of the sound emission.

SUMMARY OF THE INVENTION

In accordance with the present invention, the loading members have an essentially T-shaped cross-section and the horizontal portions or flanges of the T-shaped loading members projecting outwardly on both sides are placed on adjacent ties of the railroad track.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
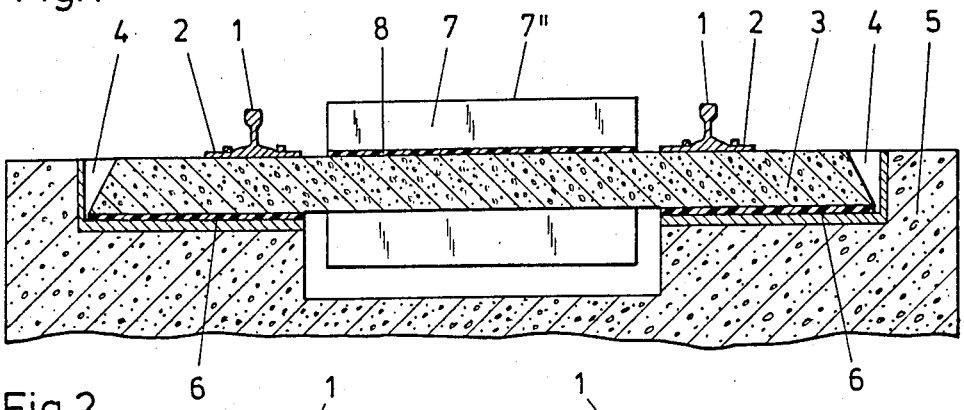
FIG. 1 is transverse sectional view of a railroad track.
Figure 2:
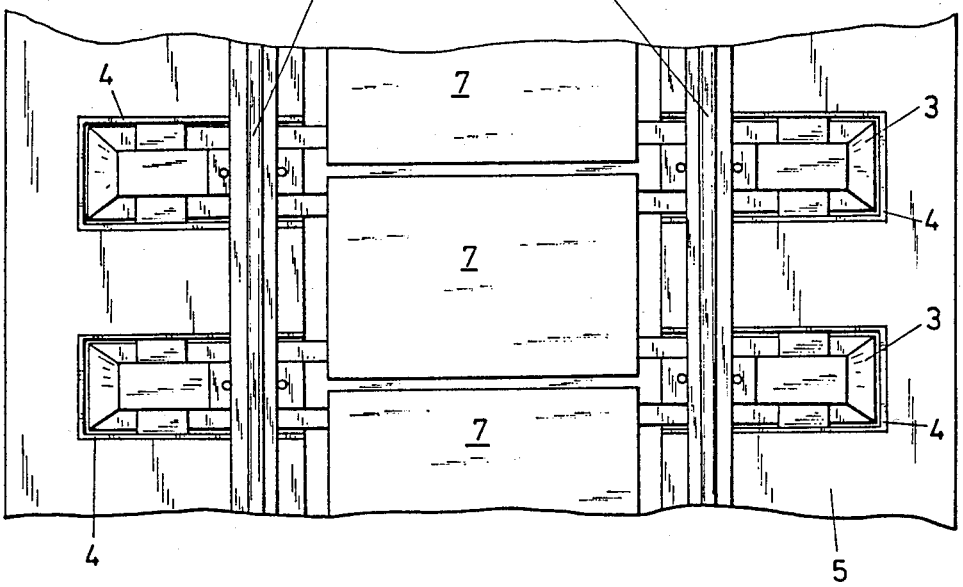
FIG. 2 is a top view of the railroad track illustrated in FIG. 1.
Figure 3:
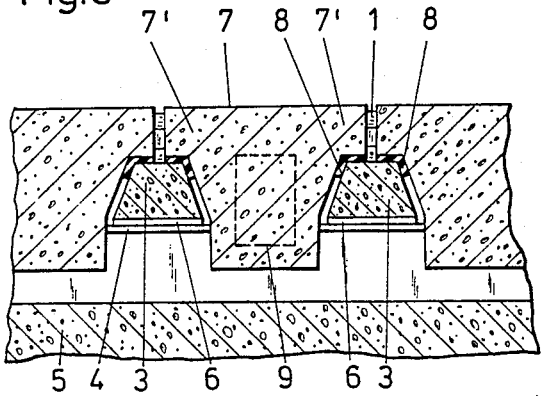
FIG. 3 is a longitudinal sectional view of the railroad track illustrated in FIG. 1.

The railroad track illustrated in the drawing includes a pair of rails 1 arranged at a distance from one another. The rails 1 are fastened to transversely extending ties 3 by means of suitable fittings 2. The ties 3 are provided with equal spacing along the rails 1, as shown in FIGS. 2 and 3. The ties 3 are suitably manufactured of concrete or of hollow steel sections filled with concrete. It is possible to use other materials for manufacturing the ties, however it is important to use ties having a great weight.

The end portions of each tie 3 rest in recesses 4 of a concrete base 5 which may have an essentially U-shaped cross-section and may be formed, for example, by a bridge structure. Instead of a concrete base 5, it is also possible to use a steel structure which has trough-like support members in which the end portions of the ties are embedded.

In the aforementioned recesses 4 of the concrete base 5, the end portions of the ties 3 are placed on sound-insulating layers 6 which are preferably elastic.

The loading members 7 are arranged on the portions of the ties 3 which extend between the rails 1. The loading members 7 are manufactured of solid concrete and have an essentially T-shaped cross-section, as can be seen in FIG. 3. The horizontal portions 7' of the loading members which project outwardly on both sides are placed on the top sides of adjacent ties 3. Elastic intermediate layers 8 are placed between the ties 3 and the horizontal portions 7' of the loading members 7.

In order to utilize the space available between the ties in an optimum manner, the portion of the loading member 7 which extends downwardly from the horizontal portion 7', or the web portion of the loading members 7, has a shape which corresponds to the shape of the space between adjacent ties 3. In the embodiment illustrated in FIG. 3, the ties have a trapezoidal cross-section and, for this reason, the portion of the loading members 7 immediatly adjacent to the ties has obliquely inclined outer surfaces.

The loading members 7 may have at least one longitudinally extending hollow space which is open to both ends of the loading member 7. Such a hollow space is indicated in FIG. 3 by a broken line 9. This hollow space may be filled with materials which have a greater specific gravity than that of concrete, so that the available weight of the loading members is increased. This hollow space may have any cross-sectional shape and either a single hollow space or a plurality of hollow spaces may be provided in each loading member 7. The purpose of the hollow spaces in the loading members 7 is to be able to carry the weight of each loading member 7 and as a result, the natural frequency of the railroad track system. In practice, the variation is obtained in most cases by varying the density of the material used for manufacturing the loading member. The possible fillers for concrete are, for example, barite or iron scrap.

As mentioned above, elastic inserts or intermediate layers 8 may be placed between the loading members 7 and the ties 3. In this type of roadway, by selecting a certain elasticity of the intermediate layers, the natural frequency of the loading members 7 can be adjusted in relation to the natural frequency of the entire roadway placed on the elastic in the intermediate layer underneath the ties 3 in such a manner that an especially good sound insulation is obtained at certain critical frequency ranges. Thus, a two-weight oscillator system can be obtained. It is also possible to equip the various loading members with different elastic intermediate layers, so that a defined resonant frequency is avoided which would result in a reduction of the insulation efficiency due to resonance step-ups in this frequency range.

When the loading members are manufactured, hooks can be cast into the top of the members, so that lifting devices can be attached during placement of the loading members.

The loading members 7 may be made entirely of concrete. It is also possible to manufacture a steel section having the claimed cross-section and to fit this section with concrete. Moreover, the concrete members may be provided with steel reinforcements.

The railroad track in accordance with the present invention has the significant advantage that, on a railway line having varying sound protection requirements, it is possible to install the roadway continuously without having to take into consideration the sound protection requirements during the planning and construction of the railway line. After the railway line has been installed, it can be determined by measuring vibrations during driving tests whether and where additional loading members are required. Consequently, significant savings are possible because the protection against sound does not have to be initially overdimensioned, rather, the measures necessary for sound protection can be made subsequently at the necessary locations.

By placing the loading members on the railroad ties, an essentially plane surface is obtained between the rails which surface may be utilized as an escape route. Thus, the railroad track according to the invention serves particularly well to meet safety requirements. It is also conceivable to fill the space outside the rails with prefabricated concrete parts, so that a plane roadway is obtained, for example, in a tunnel, which may be utilized by road vehicles.

Thus, it is clear that the present invention as claimed meets the object of the invention in an optimum manner.

In accordance with another feature of the invention, the top surfaces 7" of the loading members 7 are vertically level with the top edges of rails 1.

While a specific embodiment of the invention has been shown and described in detail to illustrate the application of the inventive principles, it will be understood that the invention may be embodied otherwise without departing from such principles.

We claim:

1. In a railroad track including rails and ties extending transversely of and connected to the rails, the ties having end portions and portions extending between the rails the end portions of the ties placed on a rigid substructure, sound-insulating intermediate layers placed between the ties and the substructure, and solid loading members of concrete placed on the portions of the ties extending between the rails for reducing sound emission, the improvement which comprises that the loading members have an essentially T-shaped cross-section defining outwardly projecting horizontal portions, wherein the outwardly projecting horizontal portions of the loading members are placed on adjacent ties of the railroad track.

2. The railraod track according to claim 1, wherein the substructure is of concrete.

3. The railroad track according to claim 1, wherein the concrete of the loading members is reinforced concrete.

4. The railroad track according to claim 1, wherein the intermediate layers are of elastic material.

5. The railroad track according to claim 1, wherein adjacent ties define a space therebetween, and each loading member has a portion extending downwardly from the outwardly projecting portions, wherein the downwardly projecting portion has a shape which corresponds to the space defined between adjacent ties.

6. The railroad track according to claiim 1, wherein the loading member defines a longitudinally extending hollow space.

7. The railroad track according to claim 6, wherein the hollow space is open at both end portions of the ties.

8. The railroad track according to claim 1, wherein the concrete of the loading members includes an aggregate selected from the group consisting of iron scrap and barite.

9. The railroad track according to claim 1, wherein the substructure is of steel.

* * * * *